US007131153B1

(12) United States Patent
Charles

(10) Patent No.: US 7,131,153 B1
(45) Date of Patent: Nov. 7, 2006

(54) BED SKIRT PROTECTOR AND METHOD OF USE

(76) Inventor: Shirley D. Charles, 898 Golfwood Crescent, Lasalle, ON (CA) N9J 3E3

( * ) Notice: Subject to any disclaimer, the term of this patent is extended or adjusted under 35 U.S.C. 154(b) by 0 days.

(21) Appl. No.: 11/338,262

(22) Filed: Jan. 24, 2006

(51) Int. Cl.
*A47C 31/00* (2006.01)
*A47G 9/02* (2006.01)

(52) U.S. Cl. ..... 5/493; 5/659; 5/658

(58) Field of Classification Search ..... 5/493, 5/482, 659, 650, 658, 690
See application file for complete search history.

(56) References Cited

U.S. PATENT DOCUMENTS 992,101 A 5/1911 Adams
1,602,768 A * 10/1926 Harpold ..... 5/659
2,239,017 A 4/1941 Roberts
2,847,685 A * 8/1958 Freedlander ..... 5/659
5,321,861 A 6/1994 Dancey et al.

* cited by examiner

*Primary Examiner*—Alexander Grosz
(74) *Attorney, Agent, or Firm*—Raymond M. Galasso; Galasso & Associates, L.P.

(57) ABSTRACT

The bed skirt guard is designed to fit between the mattress and box spring wherein the sides form a box around the top of the box springs. This prevents the bed skirt from getting caught and pulled under the mattress when changing the sheets on the bed or tucking in the covers. The bed skirt guard is comprised of a flexible plastic material that allows the sheets and or blankets to slide easily. Since the bed skirt guard hangs over the sides of the box springs it keeps the bed skirt in place.

3 Claims, 3 Drawing Sheets

BED SKIRT PROTECTOR AND METHOD OF USE

FIELD OF THE DISCLOSURE

A protective sheet that is placed between the mattress and box springs which functions to hold a bed skirt in place while changing the linens.

BACKGROUND

Making up a bed is never an easy task, especially the more that people begin to decorate their beds. For example, if a bed skirt is included in the decoration, most of the time that bed skirt is placed between the box spring and the mattress. Although there are times when the bed skirt is actually attached in some form by a latching mechanism which is either attached to the bed frame or the mattress. By attaching the bed skirt to some other device, it makes it easier to change the sheets on a bed.

When the bed skirt is placed between the mattress and the box spring, then the task of changing the sheets becomes more cumbersome. Almost every time the sheets are tucked in between the mattress and box spring the bed skirt will get caught and fold up under the mattress. When you take into consideration that a lot of time the sheets and blankets are tucked under the mattress on three different sides so as to allow a comforter or duvet to hang down to the bed skirt without seeing the sheets and blankets, then the task of tucking in the sheets and blankets is very time consuming. Even when a bed skirt is not used, the sheets and blankets sometime want to stick to the box string. As mattresses become heavier and heavier, they become harder and harder to lift, which in turn makes sliding the sheets and blankets between the mattress and box springs an even more difficult task.

If you work in the an industry where the beds are changed on a daily basis such as at a hotel or motel, then changing the sheets is not only a burden but takes a large majority of the time that is spent in cleaning and preparing a room for the next guest. While most motels use bedspreads instead of comforters or duvets, the trend is starting to lean toward more comfortable mattress in hotel rooms. As this trend expands it increases the chances of the mattresses in hotel rooms become more heavy and cumbersome, thereby making it harder to lift the mattress for purposes of changing the linens.

SUMMARY OF THE DISCLOSURE

In one embodiment the bed skirt protector comprises a flat section.

In another embodiment the bed skirt protector comprises a first side section.

In yet another embodiment the first side section attaches to the flat section.

In still another embodiment the first side section is substantially perpendicular to the flat section.

In another embodiment the bed skirt protector comprises a second side section.

In yet another embodiment the second side section attaches to the flat section.

In still another embodiment the second side section is substantially perpendicular to the flat section.

In another embodiment the first side section and the second side section are substantially horizontal.

In yet another embodiment the bed skirt protector comprises a third side section.

In still another embodiment the third side section attaches to the flat section.

In another embodiment the third side section is substantially perpendicular to said flat section.

In yet another embodiment the third side section is substantially perpendicular to the first side section and the second side section.

In still another embodiment the bed skirt protector comprises a fourth side section.

In another embodiment the fourth side section attaches to the flat section.

In yet another embodiment the fourth side section is substantially perpendicular to the flat section.

In another embodiment the fourth side section is substantially perpendicular to the first side section and the second side section.

In still another embodiment the fourth side section is substantially horizontal to the third side section.

In yet another embodiment the first and third side sections attach to form a corner.

In another embodiment the first and fourth side sections attach to form a corner.

In still another embodiment the second and third side sections attach to form a corner.

In yet another embodiment the first and fourth sections attach to form a corner.

In another embodiment the second and fourth side sections attach to form a corner.

In still another embodiment the first side section, second side section, third side section and fourth side section measure approximately 2 inches in height.

In yet another embodiment the flat section is comprised of a flexible plastic.

In another embodiment the flat section is comprised of a clear plastic.

In still another embodiment the bed skirt guard is operable to fit a twin bed.

In yet another embodiment the bed skirt guard is operable to fit a full size bed.

In another embodiment the bed skirt guard is operable to fit a queen size bed.

In still another embodiment the bed skirt guard is operable to fit a king size bed.

In yet another embodiment the bed skirt guard is operable to fit a California king size bed.

Still other advantages of various embodiments will become apparent to those skilled in this art from the following description wherein there is shown and described preferred embodiments of this invention simply for the purposes of illustration. As will be realized, the invention is capable of other different aspects and embodiments without departing from the scope of the invention. Accordingly, the advantages, drawings, and descriptions are illustrative in nature and not restrictive in nature.

DETAILED DESCRIPTION OF THE DRAWING FIGURES

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
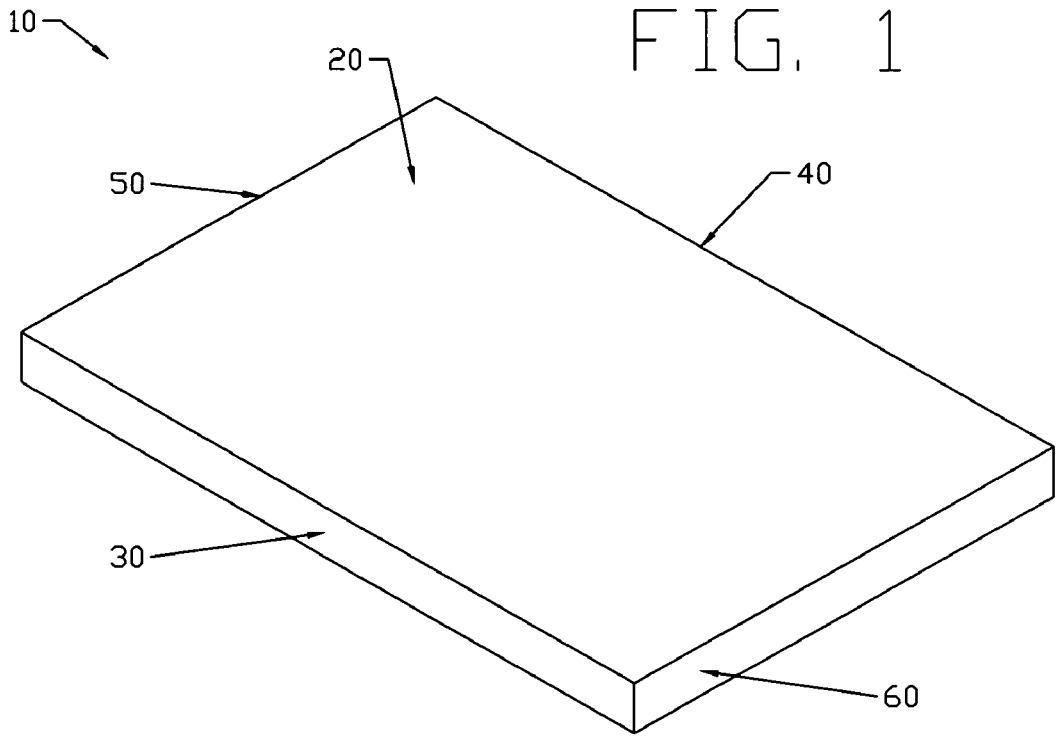
FIG. 1 is a perspective view of a bed skirt guard.

FIG. 1 depicts a bed skirt guard 10 which is comprised of a flat section 20, a first side section 30, a second side section 40, a third side section 50 and a fourth side section 60. The flat section 20 is comprised of a transparent material such as plastic which will allow the linens to slide easily. The first side section 30 is attached to the flat section 20 and hangs downward toward the floor. The second side section 40 is also attached to the flat section 20 on the opposite side of the first side section 30 and hangs downward toward the floor. The third side section 50 is also attached to the flat section 20 and hangs downward toward the floor. The fourth side section 60 is attached to the flat section on the opposite end of the third side section 50 and hangs downward toward the floor. Additionally, the first side section 30 and the third side section 50 attach to form a corner. The first side section 30 also attaches to the fourth side section 60 on the opposite end of where the third side section 50 attached to the first side section 30 to form a corner. The second side section 40 attaches to the third side section 50 to form a corner on the opposite end of where the third side section 50 and the first side section 30 connected. Additionally, the second side section 40 and the fourth side section 60 connect on the opposite end of the third side section 50 and second side section 40 corner to form a corner. By attaching all of the side sections to the flat section 20, the bed skirt guard forms somewhat of a box.

The flat section 20 of the bed skirt guard 10 is placed between the mattress and box springs on top of a bed skirt on a typical bed comprising a bed skirt. Once the flat section 20 is spread out over the box springs, then the side sections hang down over the upper portion of the bed skirt. The side section hanging down over the edge of the bed skirt forms somewhat of a box and prevents the bed skirt from getting caught on the linens when the linens are tucked in between the mattress and box springs.

Figure 2:
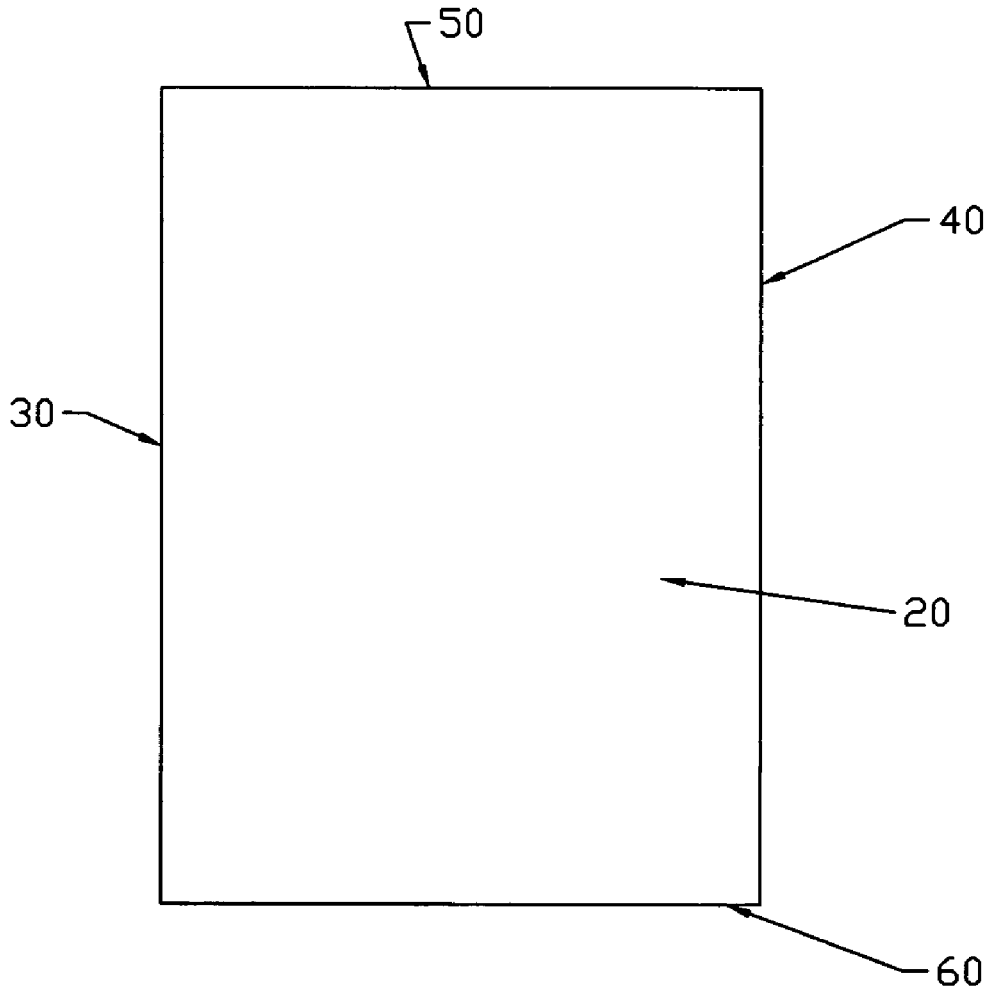
FIG. 2 is a top view of the bed skirt guard depicted in FIG. 1

FIG. 2 is a top view of the bed skirt guard 10 and shows the flat section 20 which is stretched out between the mattress and box springs on top of the bed skirt. While the typical flat section 20 would be comprised of transparent or clear flexible plastic, it is also possible for the flat section 20 to be comprised of a material which would allow for color, such as would match or blend with the bed skirt.

Figure 3:
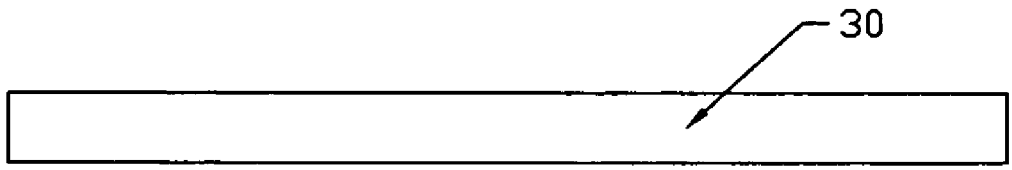
FIG. 3 is a side view of the bed skirt guard depicted in FIG. 1.

FIG. 3 illustrates a side view of the bed skirt guard 10 and shows how the side sections would hang down over the bed skirt. The side section of the bed skirt guard can vary in different lengths. Typically, the first side section 30, the second side section 40, the third side section 50 and the fourth side section 60 would measure between 1 and 3 inches in height depending upon the desire of the user.

What is claimed is:

1. A method for making a bed comprising a mattress and box springs, with a bed skirt protector which includes a flat section and four sides extending downward from said flat section and substantially creating an open box; comprising the steps of:

placing said flat section between the mattress and box springs;

arranging the sides so that they hang off the edge of the box springs over the bed skirt;

placing the mattress back on top of the box springs;

spreading out a bottom sheet on the mattress and tucking the corners under the mattress;

placing a top sheet on top of said bottom sheet and tucking in said top sheet under the mattress;

putting on a bedspread/comforter/duvet.

2. The bed skirt protector of claim 1, wherein said four sides, measure approximately 2 inches in height.

3. The bed skirt protector of claim 1, wherein said flat section is comprised of clear flexible plastic.

* * * * *